United States Patent [19]

Bajo

[11] Patent Number: 4,787,872

[45] Date of Patent: Nov. 29, 1988

[54] PINATA CONSTRUCTION

[76] Inventor: Ricardo Bajo, 214 Morris St., Fairview, N.J. 07022

[21] Appl. No.: 40,335

[22] Filed: Apr. 20, 1987

[51] Int. Cl.[4] ..... A63H 33/00

[52] U.S. Cl. ..... 446/5; 446/475; 446/487

[58] Field of Search ..... 446/5, 475, 487; 428/7, 428/9, 16; 47/67, 72; 220/266, 359

[56] References Cited

U.S. PATENT DOCUMENTS

| | | | |
|---|---|---|---|
| 797,175 | 8/1905 | Collenburg et al. | 47/72 |
| 1,039,722 | 10/1912 | Fullman | 220/266 |
| 2,201,779 | 5/1940 | Lathrop | 47/72 |
| 2,789,524 | 4/1957 | Crawford et al. | 220/266 |
| 3,340,133 | 9/1967 | Krekovich | 428/9 |
| 3,702,675 | 11/1972 | Bajo | 446/5 |
| 4,125,665 | 11/1978 | Bemmels et al. | 220/359 |
| 4,167,234 | 9/1979 | Gordon et al. | 220/359 |
| 4,253,266 | 3/1981 | Bajo | 446/5 |
| 4,379,797 | 4/1983 | Cole | 428/9 |
| 4,418,497 | 12/1983 | Mastriano | 47/67 |

FOREIGN PATENT DOCUMENTS

| | | | |
|---|---|---|---|
| 2094622 | 9/1982 | United Kingdom | 428/7 |

*Primary Examiner*—Robert A. Hafer
*Assistant Examiner*—Charles H. Harris
*Attorney, Agent, or Firm*—Stefan J. Klauber

[57] ABSTRACT

A reusable pinata has a body with a frangible bottom closure surface which is replaceable, and a top closure surface which is outlined to define punch-out or cut-out areas for permitting access to the interior of the pinata body when desired. The pinata may have a hood overlying the top closure surface and the body, the hood being preferably bell-shaped and formed from at least one expansible paper unit.

5 Claims, 4 Drawing Sheets

PINATA CONSTRUCTION

FIELD OF THE INVENTION

This invention relates generally to amusement devices, and is more specifically concerned with party devices of the type commonly known as pinatas.

BACKGROUND OF THE INVENTION

The pinata is an amusement device which has for many years found favor for use at parties and numerous other festive occasions, especially those attended by children. Although the pinata is known and widely enjoyed by members of all cultures, it is particularly popular among the Hispanic population where the pinata has most commonly been formed of clay or the like and has commonly taken the form of a boat, an animal or some fanciful figure, such as Santa Claus. Pinatas of this type are generally filled with candy, coins, toys or other novelties attactive to children, and are suspended by wires or strings from the ceiling or other supporting structure. The children are blindfolded and attempt to break the pinata with a bat or the like and thereby release the prized contents thereof.

More recently, it has been known to construct the pinata of paper mache or other frangible material and generally to include a bottom paper closure which is torn or broken by the child pulling a cord or similar attachment secured to the closure, or otherwise breaking the closure.

In any case, most of the pinatas of the prior art have been constructed as devices intended for a single use and are generally destroyed during the course of such use. Following use, they are normally discarded, with the result that the pinata tends to be a relatively high-cost decoration or amusement device and, where expense is a factor, its attractiveness is thereby limited. In my U.S. Pat. Nos. 3,702,675 and 4,253,266, I have, however, disclosed a pinata construction which overcomes many of these prior-art problems. The pinatas described in my patents are reusable in that they include a frangible bottom formed from paper or the like which is broken at the time of use but which can be readily replaced and the pinata stored for reuse at another time. Another pinata which includes a weakened bottom wall is disclosed in Oquita, U.S. Pat. No. 4,015,364. Paper pinatas are also shown in my design applications Ser. Nos. 641,433 and 641,447.

Some of these prior reusable pinatas, however, do not initially enclose and conceal the contents so that when they are shipped the contents readily fall out and may become lost. If the pinata does enclose the contents, as in the case with the original form of the pinata, and the pinata disclosed by Oquita, the contents are sealed in the pinata and it is not possible to add to the contents, which it is often desired to do, and refilling the pinata after it has once been used and has been prepared for reuse by filling it and closing the frangible bottom presents a problem.

It is, accordingly, an object of the invention to provide a reusable pinata in which the contents are enclosed for ease of shipment and concealment, but which permits items to be added prior to its first use and which also permits refilling of the pinata when it is desired to reuse it after it has been once used and a new frangible bottom closure has been applied to it.

It is another object of the invention to provide a pinata of the character indicated which is also provided with a removable decorative cover which not only adds to the decorative effect of the pinata, but which also conceals the top closure and any exposed contents.

SUMMARY OF THE INVENTION

In accordance with the invention, the pinata comprises a closed container having a body which is suitably drum shaped, and is filled with novelties and has a frangible bottom closure, with associated means for breaking the frangible bottom closure when desired A top closure is provided which has at least one punch-out or otherwise openable area to permit that area to be opened to allow access to the interior of the container, and suspending means for hanging the container which suspending means extends through the top closure and is secured interiorly to the container body. An expansible paper hood is provided to sit on top of the container and cover the top closure and conceal any portions of the top closure which may have been opened e.g. by being punched out, and thereby conceal any otherwise exposed contents The hood may be removably attached to the suspending means to assist in holding it in place.

DETAILED DESCRIPTION OF THE INVENTION

Figure 1:
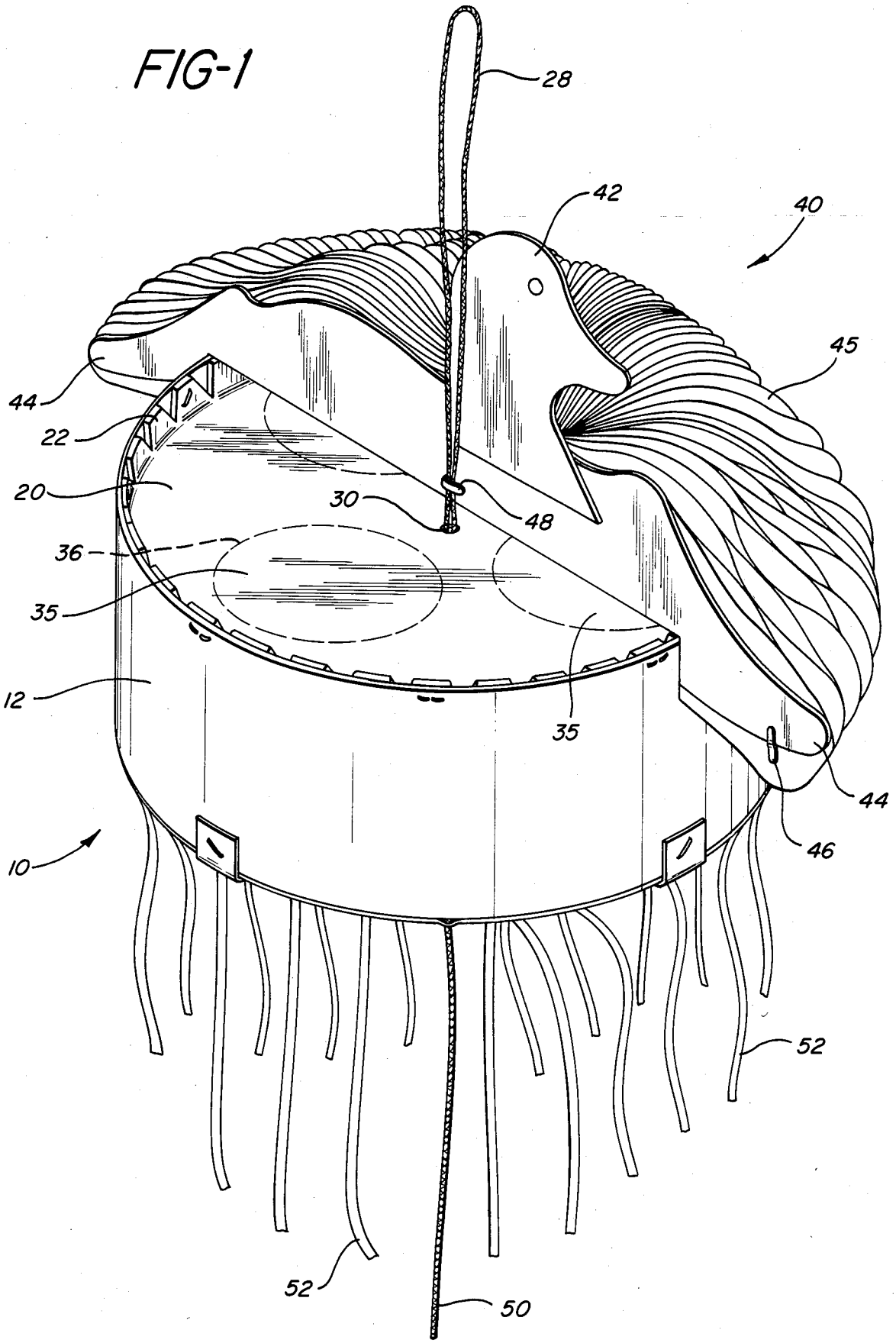
FIG. 1 is a perspective view, partially cut away to show details of construction, of a pinata construction embodying features of the present invention.

Referring now to the drawings, and particularly to FIG. 1, the reference numeral 10 designates generally the pinata of the invention in a preferred form. In FIG. 1 the pinata is depicted in a fully assembled form as it will appear when in use and when suspended from an overhead point.

Figure 2:
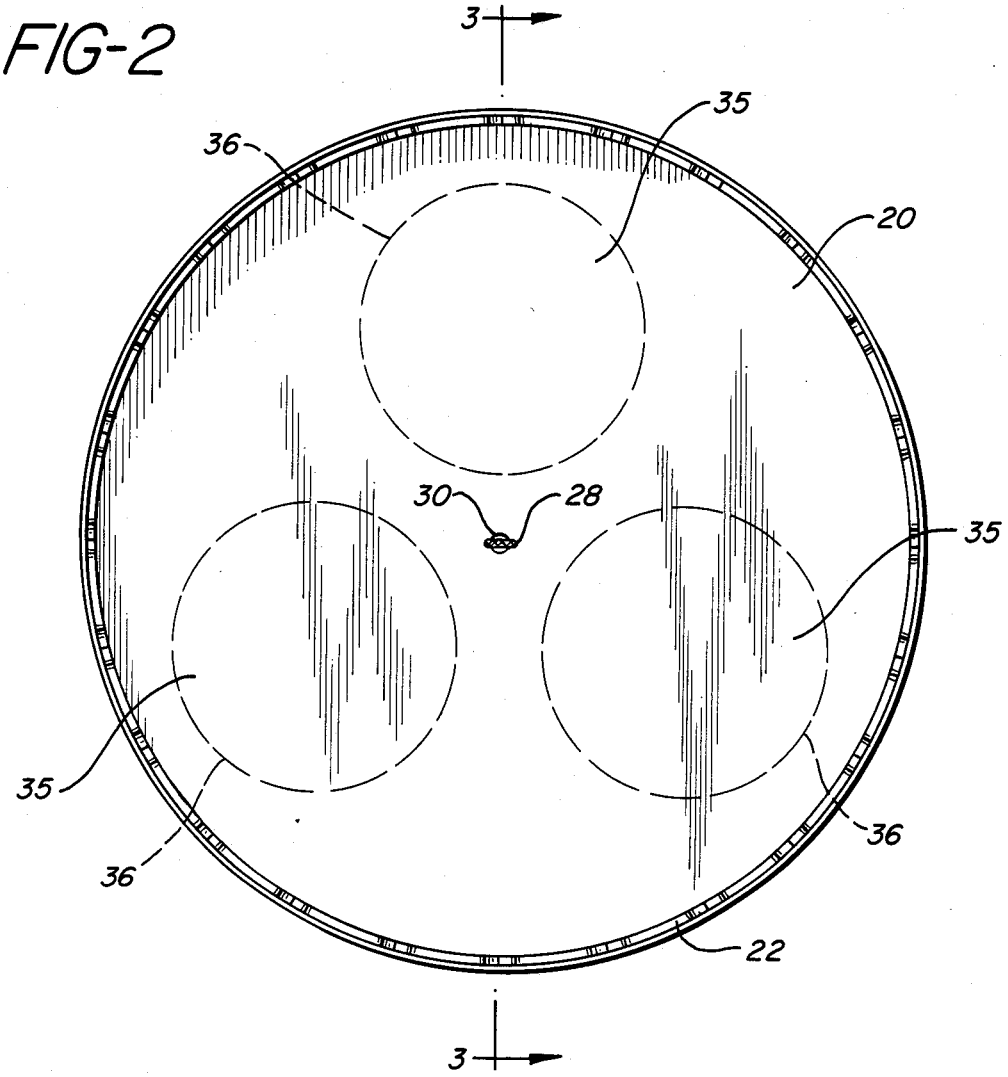
FIG. 2 is a top plan view of the pinata shown in FIG. 1, cut away to show the top of the body portion of the pinata.
Figure 3:
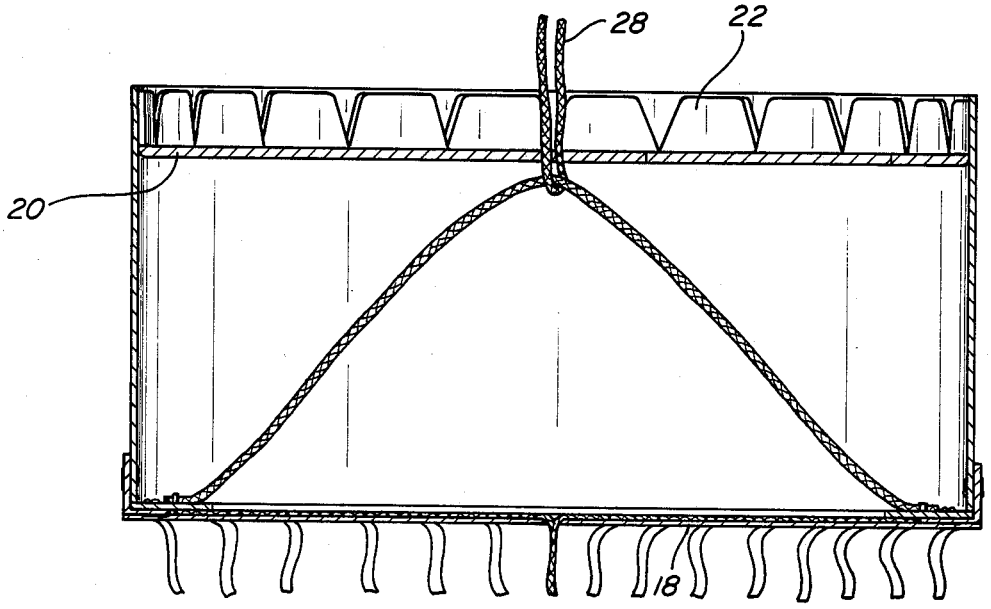
FIG. 3 is a transverse sectional view, partly in elevation, of the pinata construction shown in FIG. 1 and taken approximately along the line 3—3 of FIG. 2.
Figure 4:
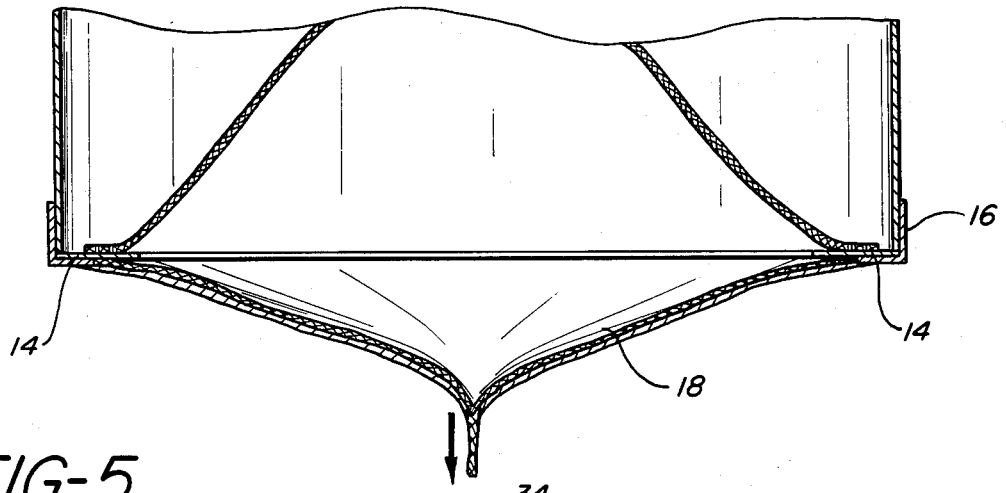
FIG. 4 is a fragmentary vertical sectional view similar to a portion of FIG. 3 but showing one manner of rupturing the frangible bottom of the pinata embodiment shown in FIGS. 1–4.
Figure 5:
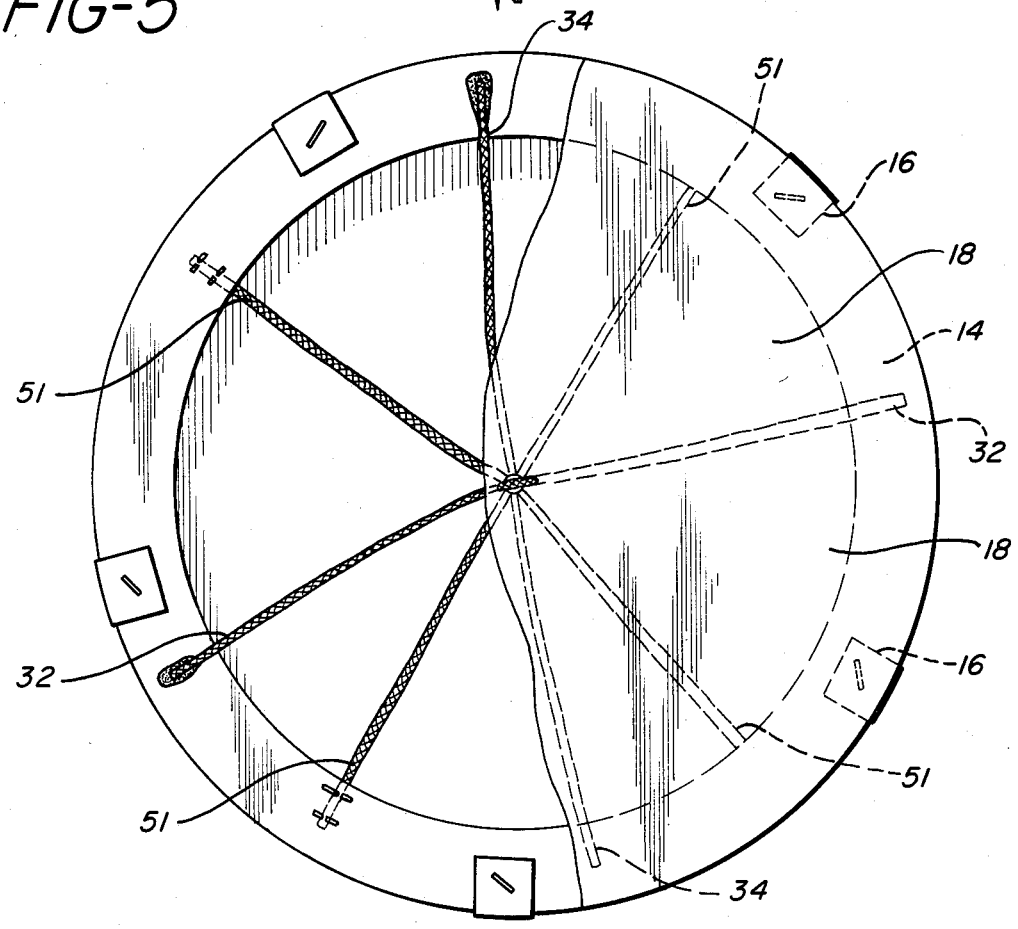
FIG. 5 is a bottom view, partly broken away, of the pinata of FIGS. 1–4.

As may be seen by simultaneous reference to FIGS. 1 through 3, the pinata 10 comprises a body 12 generally in the nature of a container and having, as illustrated, an approximately drum-shaped form, i.e. it has a circular crosssection, but it can have a cross-section which is square or rectangular or of other polygonal shape,, if desired. The body 12 has an inwardly-directed circular flange 14 at its lower end which is conveniently attached to the cylindrical portion of the body 12 by braces 16 which are respectively attached, as by stapling, to the cylindrical portion of the body 12 and to the flange 14. The flange 14 may be integrally connected to the cylindrical portion of body 12, if desired, by making appropriate V-shaped cut-outs (not shown) in it to permit it to be bent inwardly at right angles to conform to the cylindrical portion of the body in a conventional manner. The body 12 has a bottom closure 18, which is suitably formed from paper or other readily frangible material, and which is secured to the flange 14 as by gluing or the like. The top of body 12 is closed by-a top closure 20 which is circular in form and has V-shaped cut-outs in its rim to define upstanding ears 22 which are secured, as by gluing or stapling, to the cylindrical portion of the body 12. The body 12 is filled with novelties such as small toys, candy, nuts and the like, as are conventionally contained in traditional pinatas. A suspending cord 28 is received through a central aperture 30 in top closure disc 20 and is connected to support strings 32 and 34 which are secured in spaced relationship to flange 14 to permit the body 12 and its contents to be suspended from some overhead point, as illustrated. In addition, the closure disc 20 is formed with openable areas in the form of punch-out or cut-out areas 35 defined by perforation lines 36 which permit access to the interior of body 12 to be gained, when desired, without damaging or destroying the appearance and utility of the pinata, for the purpose of adding, for example, small personal novelties or gifts to the contents of the pinata before it is used. While each punch-out area 35 is completely enclosed by perforation lines 36 so that the entire area will be punched out, some of the perimeter of the area, e.g. 10%, can be unperforated so that it will act as a hinge when the remainder is punched out. Further, while the punch-out areas 25 have been illustrated as circular, they can be of any desired configuration, e.g. oval, rectangular, and the like.

To cover the pinata and to conceal any punched-out portions that may have been made in top closure 20, and to add to the decorative appearance of the pinata as a whole, is a hood 40 which, when fully expanded, completely overlies the top of the body 12. In the embodiment illustrated, the hood 40 takes the form of a flat support member 42, which itself can be shaped in a fanciful manner, i.e. to depict the outline of a dog, or rabbit, or cat, or the like and, to support member 42, are attached the rigid end panels 44 of two expansible and conractable paper decorative units 45 (only one is shown) made by cutting and pasting tissue paper in a conventional manner so that together, when expanded, they give the hood a desired configuration. Member 42 can be printed on one or both sides, in colors and/or with patterns or graphics; and can extend upwardly as desired, e.g. to a point close to the end of cord 28. In the embodiment illustrated the hood has a somewhat bell-shaped configuration but it may be shaped as a tree or ball or a cartoon character, or it may have any other desired like shape. The units 45 can also have a vertical height as desired, e.g. can extend vertically to a point closer to the top of cord 28 than the specific design shown in FIG. 1. It will be noted that this expandible construction of the hood is like that employed in many tissue paper novelties and Christmas tree ornaments. It is similar to that employed in U.S. Pat No. 2,310,711 the disclosure of which is incorporated herein by reference. In accordance with the invention, the end panels 44 of the decorative expansible paper units are of generally L-shaped configuration so that they closely fit the top of the body 12, with a result that when the units are expanded and fully opened, they define a circular recess into which the body 12 is readily received and the hood 40 is held against displacement. It will be seen that the single unit 45 of the embodiment illustrated shows only a semi-circular recess. The other half of the the circular recess is formed by a second unit (not shown) which has an end panel attached to support member 42. The rigid end panels 44 of the decorative expansible units are joined, when they are fully expanded, by a clip 46, in conventional manner. In addition, the inner end of each expansible unit is suitably formed with a clip 48 through which the suspending cord 30 is received as it passes upwardly from the body 12. It will, of course, be understood that while the embodiment illustrated has been described in terms of two cooperating expansible decorative paper units, each of which is opened by 180°, a single expansible decorative paper unit can be employed which can be opened by a full 360° to form the entire bell-shaped dome.

The rupture of the bottom frangible closure 18 when the pinata 10 is in use can be accomplished in any conventional manner, such as illustrated in my above-mentioned U.S. Pat. Nos. 3,702,675 and 4,253,266, both of which are incorporated herein by reference. There may, for example, be provided a central pull cord 50 which extends through an aperture in bottom closure 18 and which is connected interiorly of body 12 to cross-strings 51 as described by prior U.S. Pat. No. 3,702,675. Additional strings 52 may be, as described in that patent, directly connected to the bottom frangible bottom closure or they may be merely decoy strings (not shown) which are, for example, connected to the top closure 20 and do not break the bottom closure when they are pulled. Such construction both adds to the merriment by causing the child seeking to rupture the pinata first to find the active line which must be pulled to cause the contents of the pinata to spill out and he will often be fooled by the decoy strings which do not cause the pinata to rupture.

Figure 6:
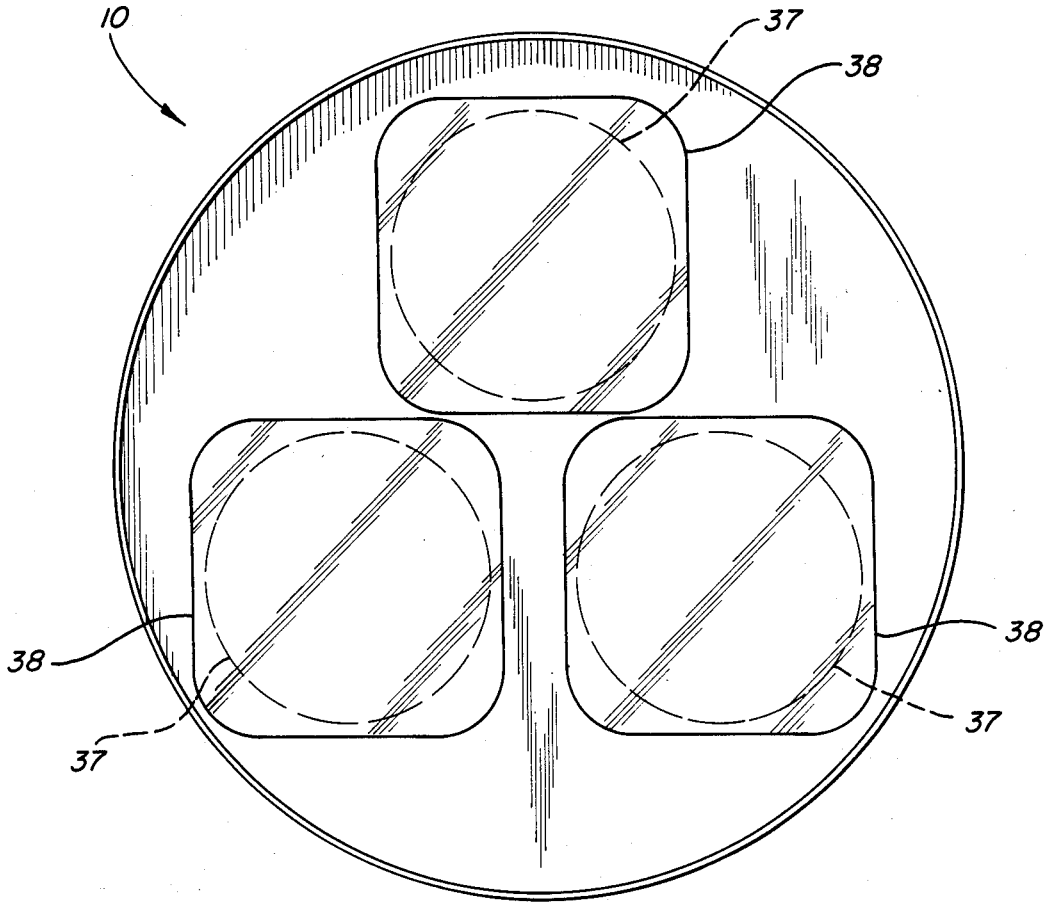
FIG. 6 is a top view of the body of another embodiment of the pinata of the invention showing the top closure with releasably-covered openable areas.

A feature of the present invention is the provision of means for access to the normally-closed pinata body, e.g. the body 12. Described above and illustrated in FIGS. 1 and 2 is the provision of punch-out areas 35. Other means of access can also be provided, e.g. openings with closures. Thus as seen in FIG. 6, for example, the top closure 20 may be provided with holes 37 which are covered by a readily openable or removeable closure, e.g. sheets of pressure-sensitive paper 38 which can be peeled back to permit access and then replaced in closing position.

It will, of course, be understood that various other changes and modifications may be made in the invention as described and illustrated without departing from its scope as defined in the appended claims and it is intended therefore that all matter contained in the foregoing description and in the drawings shall be interpreted as illustrative only and not as limitative of the invention.

I claim:

1. A reusable pinata comprising a body having a top closure surface and a bottom closure surface, said bottom closure surface being frangible and replaceable, means depending from said body for rupturing said frangible bottom surface, and means for suspending said body from an overhead point, said top closure surface extending entirely across the top of said body and said body being normally sealed by said top closure surface and said bottom closure surface but said top closure surface being formed with openable areas in the form of areas of demarcation to permit access to the interior of said body for the introduction of items therein and a hood overlying and concealing said top closure surface but overlying only an upper portion of the side walls of said body; said hood being substantially bell-shaped and being formed form a pair of decorative expansible paper units.

2. A reusable pinata as defined in claim 1, wherein said body is in the form of a drum.

3. A reusable pinata as defined in claim 1, wherein said openable areas comprise perforated punch-out areas.

4. A reusable pinata as defined in claim 1, wherein said openable areas comprise apertures and closures therefor sealing said apertures.

5. A reusable pinata comprising a body having a top closure surface and a bottom closure surface, said bottom closure surface being frangible and replaceable, means depending from said body for rupturing said frangible bottom surface, and means for suspending said body from an overhead point, said top closure surface extending entirely across the top of said body and said body being normally sealed by said top closure surface and said bottom closure surface but said top closure surface being formed with openable areas in the form of areas of demarcation to permit access to the interior of said body, for the introduction of items therein, said body being in the form of a drum, and a hood overlying and concealing said top closure surface but overlying only an upper portion of the side walls of said body, said hood being substantially bell-shaped and being formed from a pair of decorative expansible paper units.

* * * * *